US010377030B2

(12) United States Patent
Gallegos

(10) Patent No.: US 10,377,030 B2
(45) Date of Patent: Aug. 13, 2019

(54) TOOL HANDLE FOR HOLDING MULTIPLE TOOLS OF DIFFERENT SIZES DURING USE

(71) Applicant: Robert Joseph Gallegos, Fremont, CA (US)

(72) Inventor: Robert Joseph Gallegos, Fremont, CA (US)

(73) Assignee: Joe Gallegos Design LLC, Fremont, CA (US)

( * ) Notice: Subject to any disclaimer, the term of this patent is extended or adjusted under 35 U.S.C. 154(b) by 244 days.

(21) Appl. No.: 15/041,833

(22) Filed: Feb. 11, 2016

(65) Prior Publication Data

US 2017/0232603 A1 Aug. 17, 2017

(51) Int. Cl.
*B25B 15/00* (2006.01)
*B25G 1/08* (2006.01)
*B25F 1/02* (2006.01)

(52) U.S. Cl.
CPC ..... *B25G 1/085* (2013.01); *B25F 1/02* (2013.01)

(58) Field of Classification Search
CPC ..... B25G 1/085; B25B 15/008
See application file for complete search history.

(56) References Cited

U.S. PATENT DOCUMENTS 1,172,656 A * 2/1916 Yorgenson ..... B25B 23/16 81/177.2
2,409,613 A * 10/1946 Brooks ..... B25B 13/56 206/377
2,475,268 A * 7/1949 Wittle ..... B25B 15/008 279/102
2,532,636 A * 12/1950 Minnich ..... B25B 13/56 206/377
2,715,028 A * 8/1955 Dossie ..... B25B 13/56 81/177.4
3,592,086 A * 7/1971 Derwin ..... B25B 23/16 74/544
4,043,230 A * 8/1977 Scrivens ..... B25B 13/56 81/177.2
4,302,990 A * 12/1981 Chrichton ..... B25G 1/085 206/378

(Continued)

FOREIGN PATENT DOCUMENTS

DE 3744176 A1 * 8/1989 ..... B25B 15/008

*Primary Examiner* — Joseph J Hail
*Assistant Examiner* — Arman Milanian
(74) *Attorney, Agent, or Firm* — White-Welker & Welker, LLC; Matthew T. Welker, Esq.

(57) ABSTRACT

A tool handle for holding multiple tools of different sizes during use. A wedge and body which, when placed together, creates a handle with a generally cylindrical shape and internal cavities for retaining hexagonal wrenches. A sliding wedge holds the hexagonal wrench and itself into place. A plurality of slots that allow each size tool to be indexed to the underside of the sliding member/wedge. There are two grouping arrangement of tools within the handle: a large group and a small group facing the opposite direction. The purpose for the two groups is to optimize the function of the wedge. If all of the tools were oriented in the same main slot then the smallest tools would not protrude from the end of the handle/body in a screwdriver mode to facilitate good function. Therefore the two groupings are arranged back to back to stabilize the tools laterally.

25 Claims, 14 Drawing Sheets

(56) References Cited

U.S. PATENT DOCUMENTS

| | | | | | |
|---|---|---|---|---|---|
| 5,592,859 | A * | 1/1997 | Johnson | B25B 13/56 | 81/177.2 |
| 5,992,625 | A * | 11/1999 | Loiselle | B25H 3/003 | 206/377 |
| 6,209,425 | B1 * | 4/2001 | Hu | B25B 15/008 | 81/177.1 |
| 6,311,587 | B1 * | 11/2001 | Johnson | B25B 13/56 | 81/177.1 |
| 7,073,418 | B2 * | 7/2006 | Kuo | B25B 15/008 | 81/177.2 |
| 7,717,016 | B2 * | 5/2010 | Lai | B25B 23/0042 | 81/177.1 |
| 8,359,954 | B2 * | 1/2013 | Johnson | B25B 15/008 | 81/440 |
| 2003/0110906 | A1 * | 6/2003 | Li | B25B 15/008 | 81/177.1 |
| 2003/0136234 | A1 * | 7/2003 | Cunningham | B25B 15/008 | 81/177.4 |
| 2009/0183608 | A1 * | 7/2009 | Johnson | B25G 1/063 | 81/177.4 |
| 2011/0162490 | A1 * | 7/2011 | Chang | B25B 15/008 | 81/177.1 |
| 2013/0305886 | A1 * | 11/2013 | Gallegos | B25G 3/24 | 81/60 |
| 2016/0207189 | A1 * | 7/2016 | Chen | B25G 1/063 | |
| 2016/0354916 | A1 * | 12/2016 | Tsai | B25B 15/008 | |

* cited by examiner

TOOL HANDLE FOR HOLDING MULTIPLE TOOLS OF DIFFERENT SIZES DURING USE

FEDERALLY SPONSORED RESEARCH

Not Applicable

SEQUENCE LISTING OR PROGRAM

Not Applicable

CROSS REFERENCE TO RELATED APPLICATIONS

Not Applicable

TECHNICAL FIELD OF THE INVENTION

The present invention relates to the field of hand held tools. More specifically, the present invention relates to the field of hexagonal wrenches and related hand tools.

BACKGROUND OF THE INVENTION

Hexagonal, Allen, and Torx or starred shaped tools are manufactured and distributed in multiple English and metric sizes. Such wrenches are usually sold in a set but are also distributed individually. A typical set embodiment includes tools of multiple sizes for either English, metric, or possibly, booth, sometimes connected to a loop, or stored in a case with multiple slots for each size. These tools typically have an "L" shape where the tool is bent at a 90 degree angle such that one end of the tool is shorter than the other perpendicular end. They are often referred to as the short end/leg and long end/leg of the tool.

In most cases, the tool, to be used efficiently and effectively, must be used in combination with a handle to assist a user in transferring rotational torque to the tool, and ultimately to the fitting or screw that is desired to be turned. Some sets attempt to use a handle as storage and organization. This often results in tools that are awkward to use or difficult to manufacture and require many parts.

What is needed is an apparatus which will accept, or allow for selection of multiple sized tools and which will further enhance a user's ability to exert rotational pressure on a tool without subjecting the user to personal injury or requiring the use of additional tools which may bend or disfigure the tool, handle, or otherwise cause damage.

SUMMARY OF THE INVENTION

The present invention is a tool handle for holding multiple tools of different sizes during use. The device is comprised of a wedge and body which when placed together creates a handle with a round or substantially cylindrical shape and internal cavities for retaining tools such as hexagonal and Allen wrenches.

The present invention depends on a simple sliding wedge to hold the hexagonal wrench and itself into place. The wedge engages the body and is slideable in a lateral direction with respect to the body. A user, desiring to insert a tool, simply slides the wedge in either direction, and inserts the tool into the body of the handle.

The body of the present invention is further comprised of a plurality of slots that allow each size tool to be indexed to the underside of the sliding member/wedge. There are two grouping arrangement of tools within the body of the handle, a large group and a small group facing the opposite direction. The purpose for the two groups is to optimize the function of the wedge. If all of the tools were oriented in the same main slot then the smallest tools would not protrude from the end of the handle/body in a screwdriver mode to facilitate good function. Therefore the two groupings are arranged back to back, facing with the work end of the tools of each group facing away from each other.

These steps stabilize the tools laterally, and if the tools all extended from one end of the handle/body then the smaller the tools are, the less stability the tools have due to where the side support is located. The optimum location should be as close to where the tool exits the handle/body allowing the widest possible beam spread between where the tool sits in the handle pocket and where it exits the end of the handle/body.

The present invention employs the use of a wedge and a body of the handle for providing the provision to receive the operable end of a tool.

The wedge and body of the Handle, when slideably connected, create a channel which itself comprises one or more secondary tool openings that are oriented at stepped elevations correlating to the size of a plurality of tool sizes. These elevations are positioned such that any of the plurality of tool sizes will be secured by the sliding wedge member that moves not in a diagonally transverse direction, but on a single, lateral, X-axis direction that is parallel to the main X-axis of the handle—not at an angle relative to the main X-axis of the handle.

The distance that the securing member travels along the X-axis is defined by the position of each wrench along the channel and the location of the mating half-hex wedge features on the underside of the sliding wedge. This linear, single axis movement is parallel and co-planar to the top of the plurality of tools when retained inside the handle by the body. This is how the present invention is able to achieve a two piece construction of the wedge and body compared to the multi-piece constructions taught in the prior art.

TABLE OF NUMERICAL REFERENCES

1. Wedge/Slide, Sliding Wedge
2. Body
3. Tab Tensioner—small tools
4. Tab Tensioner A—large tools
5. Tab Tensioner B—large tools
6. Lateral retainers—small tools
7. Lateral retainer—large tools
8. Hard stop detent feature
9. Tool Apertures
10. Tool
11. Secondary Tool Channels
12. Side steps
13. Channel
14. and 15. Sliding Grooves
16. and 17. Retaining Protrusion
18. First End
19. Second End
20. Long End/Leg of Tool
21. Short End/Leg of Tool
22. Substantially Circular Handle Embodiment
23. Pentagonal Handle Embodiment
24. Hexagonal Handle Embodiment
25. Circular Handle Embodiment
26. Hook
27. Catch
28. Datum

BRIEF DESCRIPTION OF THE DRAWINGS

The accompanying drawings, which are incorporated herein and form a part of the specification, illustrate the present invention and, together with the description, further serve to explain the principles of the invention and to enable a person skilled in the pertinent art to make and use the invention.

DETAILED DESCRIPTION OF THE INVENTION

Figure 1:
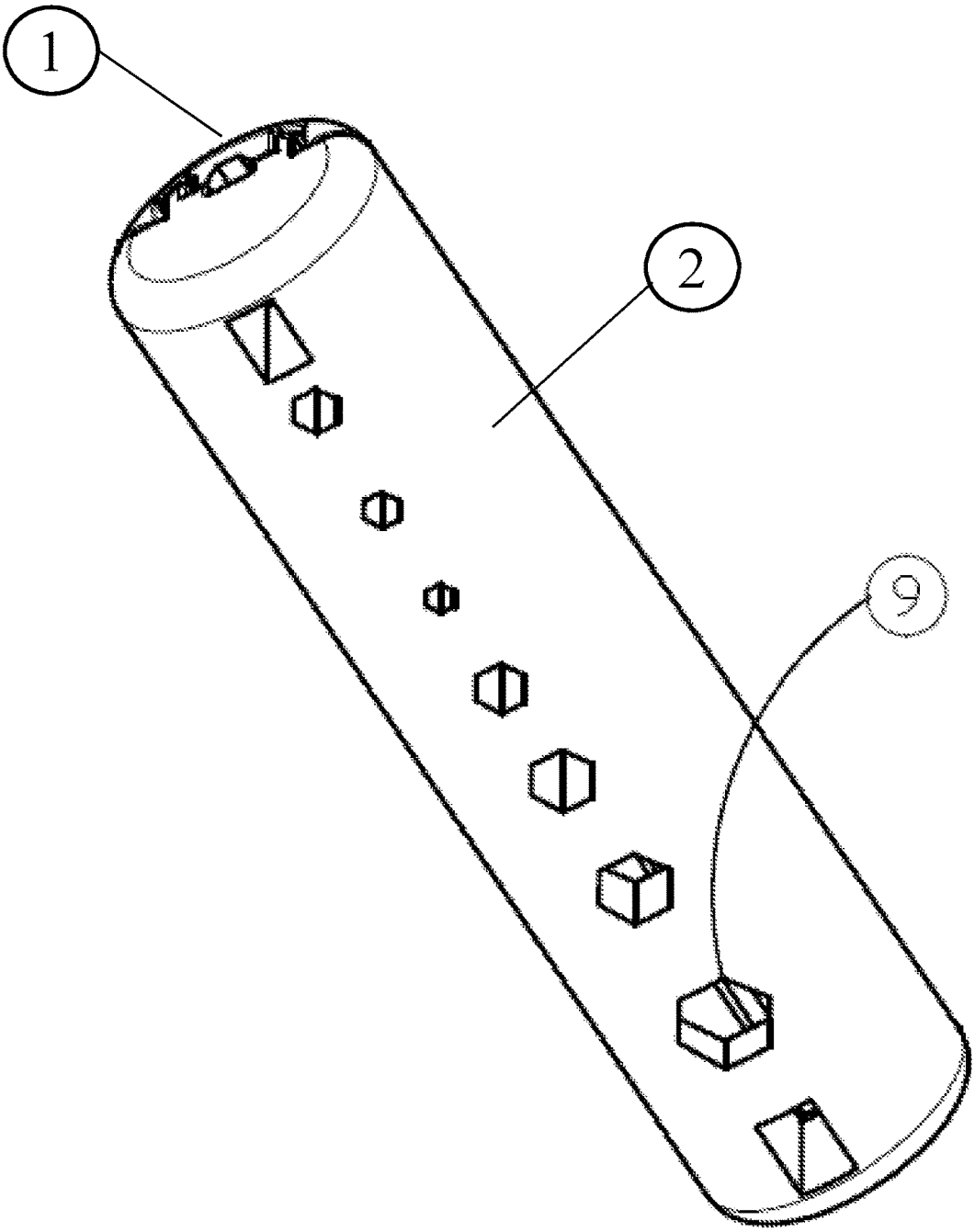
FIG. 1 is a perspective bottom view of the device of the present invention.
Figure 2:
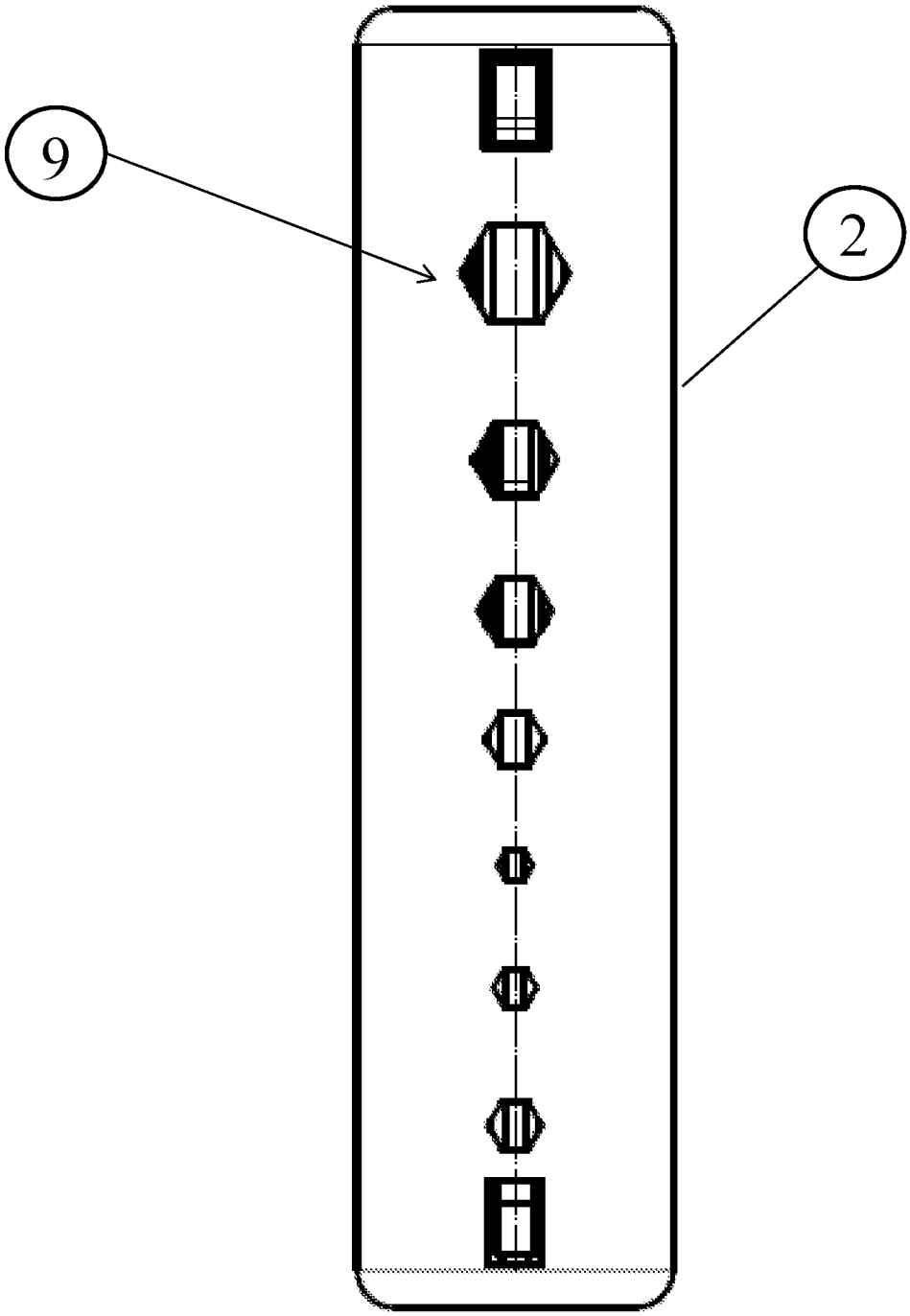
FIG. 2 is a top side view of the device of the present invention.
Figure 3:
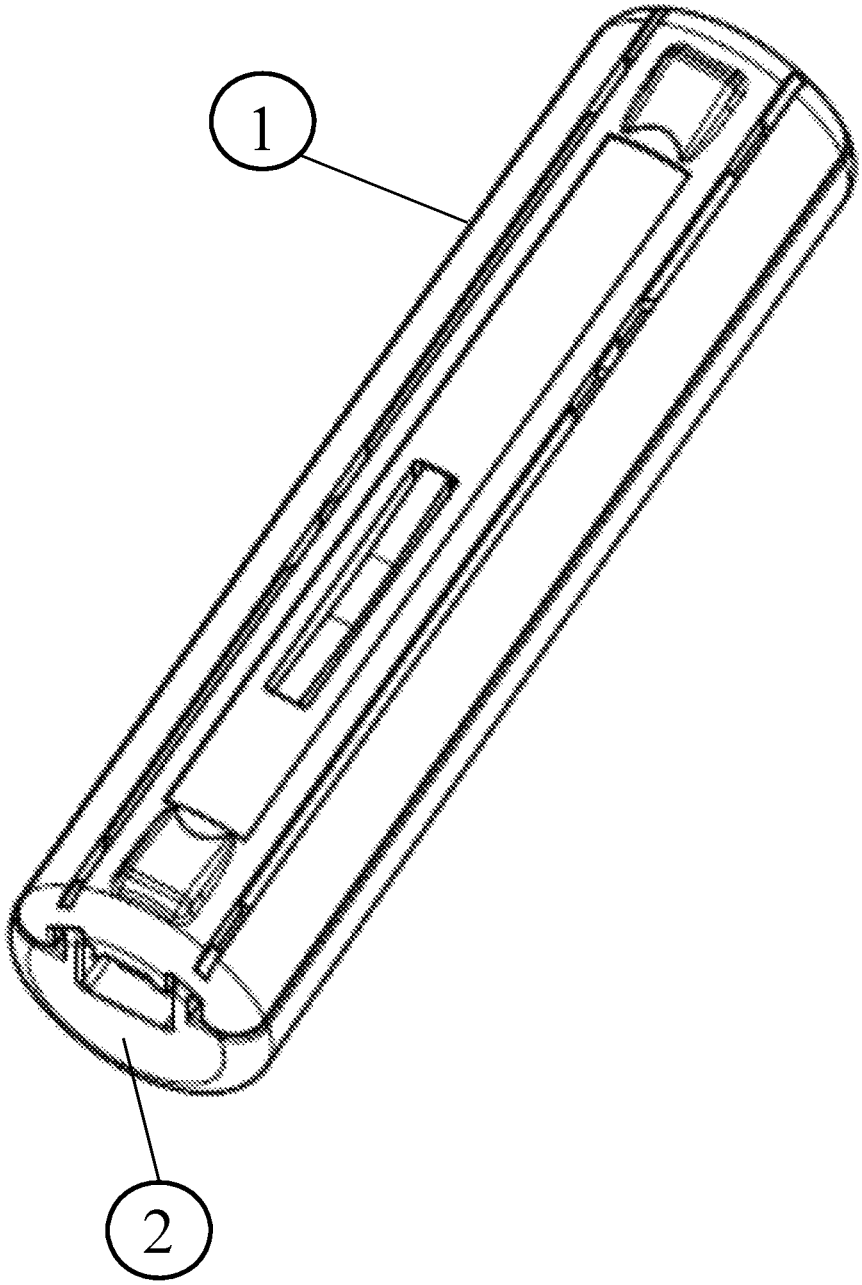
FIG. 3 is a perspective top view of the device of the present invention.

In the following detailed description of the invention of exemplary embodiments of the invention, reference is made to the accompanying drawings (where like numbers represent like elements), which form a part hereof, and in which is shown by way of illustration specific exemplary embodiments in which the invention may be practiced. These embodiments are described in sufficient detail to enable those skilled in the art to practice the invention, but other embodiments may be utilized and logical, mechanical, electrical, and other changes may be made without departing from the scope of the present invention. The following detailed description is, therefore, not to be taken in a limiting sense, and the scope of the present invention is defined only by the appended claims.

In the following description, numerous specific details are set forth to provide a thorough understanding of the invention. However, it is understood that the invention may be practiced without these specific details. In other instances, well-known structures and techniques known to one of ordinary skill in the art have not been shown in detail in order not to obscure the invention.

The present invention is a tool handle for holding multiple tools of different sizes during use. The device is comprised of a sliding wedge 1 and body 2 which when placed together create a handle with a round or substantially cylindrical shape and internal cavities for retaining tools such as hexagonal wrenches, Allen wrenches, or even Torx wrenches.

The device is comprised of a sliding wedge 1 and body 2 which when placed together create a handle with a round or substantially cylindrical shape and internal cavities for retaining tools such as hexagonal wrenches, Allen wrenches, or even Torx wrenches.

The body of the present invention is further comprised of multiple slots that allow each size of tool to be indexed to the underside of the sliding member 11 of the wedge 1. The sliding wedge member 1 does not adjust within an aperture like prior art devices, but rather the variable depth requirement is achieved by the stepped slots 12 in the body 2, allowing the tools or hexagonal wrenches to sit at different heights with in the body 2, while simultaneously being indexed against a common place with respect to the sliding wedge member 1.

The present invention depends on a simple sliding wedge 1 to securely hold and retain a tool or hexagonal wrench and itself into place. The static forces do not degrade the structure or integrity of the assembly and its function.

In a preferred embodiment, there are two grouping arrangements of tools within the handle 2, a large group 7 and a small group 6 facing the opposite direction. The purpose for the two groups 6 and 7 is to optimize the function of the wedge 1. If all of the tools were oriented in the same main slot then the smallest tools would not protrude from an end of the handle/body 18 and 19 in a screwdriver mode to facilitate good function. Therefore the two groupings 6 and 7 are arranged back to back. The other functional purpose is to optimize the stepped sides 12 of the underside of the wedge 1 in the body 2.

These stepped sides 12 stabilize the tools laterally, and if the tools all extended from one end of the handle/body 2 then the smaller the tools are, the less stability the tools have due to where the stepped sides support 12 is located. The optimum location should be as close to where the tool exits the handle/body 2 allowing the widest possible beam spread between where the tool sits in the handle pocket or channel 13 and where it exits the end of the handle/body 18 and 19 or protrudes from a tool aperture 9 from the body 2.

This orientation is referred to as a "wing-on-wing arrangement", where the wings are the legs of the tool 20 and 21. This orientation allows for improved tool extension of all tools, not just the smaller ones from either a handle end 18 and 19 or a tool aperture 9 from the body 2.

The present invention does not require or use a v-shaped channel as commonly taught by related prior art devices it can be any number of shapes, and those shapes are not integral to the function. The present invention has two Channels for laterally retaining both small and large tools 6 and 7 which are facing in opposite directions. The present invention employs the use of a first sliding wedge 1 and a body 2 which are slideably connected to create the handle for providing the necessary provision to receive and retain the operable end of a tool.

The body 2 of the present invention employs a channel 13 for retaining one tool end/leg which perpendicularly corresponds to a plurality of secondary tool channels 11 which results in a plurality of tool aperture openings 9 that are oriented at stepped elevations correlating to a plurality of tool sizes.\

Figure 4A:
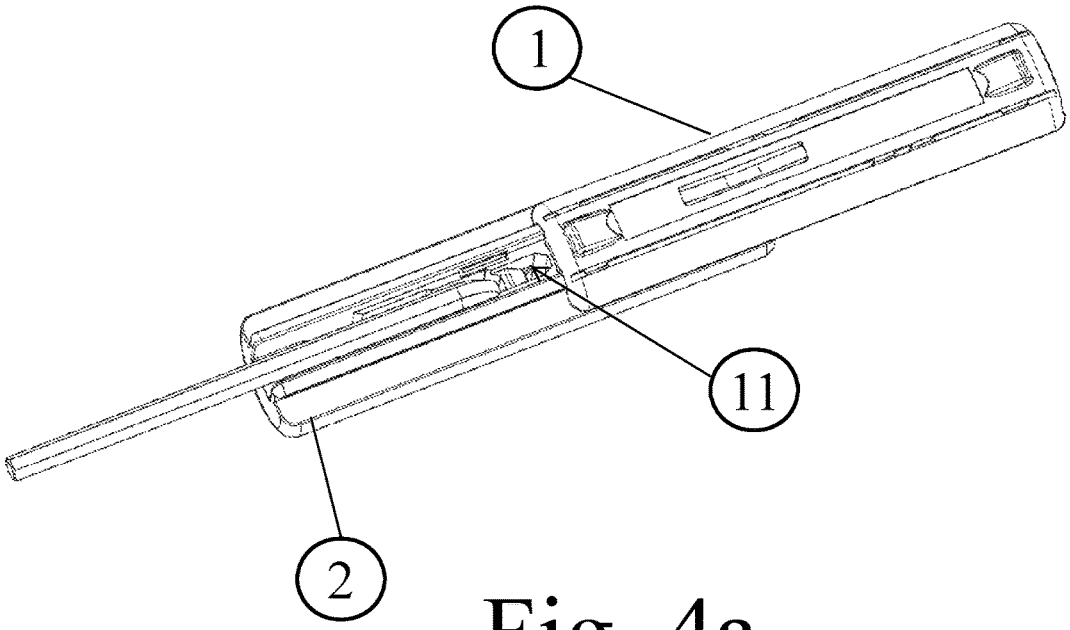
FIGS. 4*a* and 4*b* are perspective views of the handle with a tool in the screwdriver orientation/mode with the wedge slide to an open position for inserting a tool in the large and small body groups and illustrating an open wedge position.
Figure 4B:
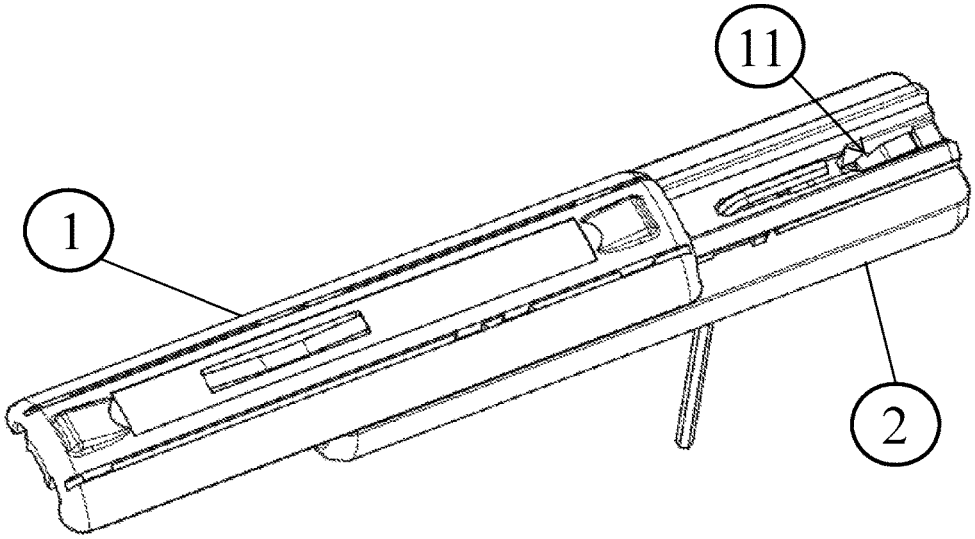
Figure 5:
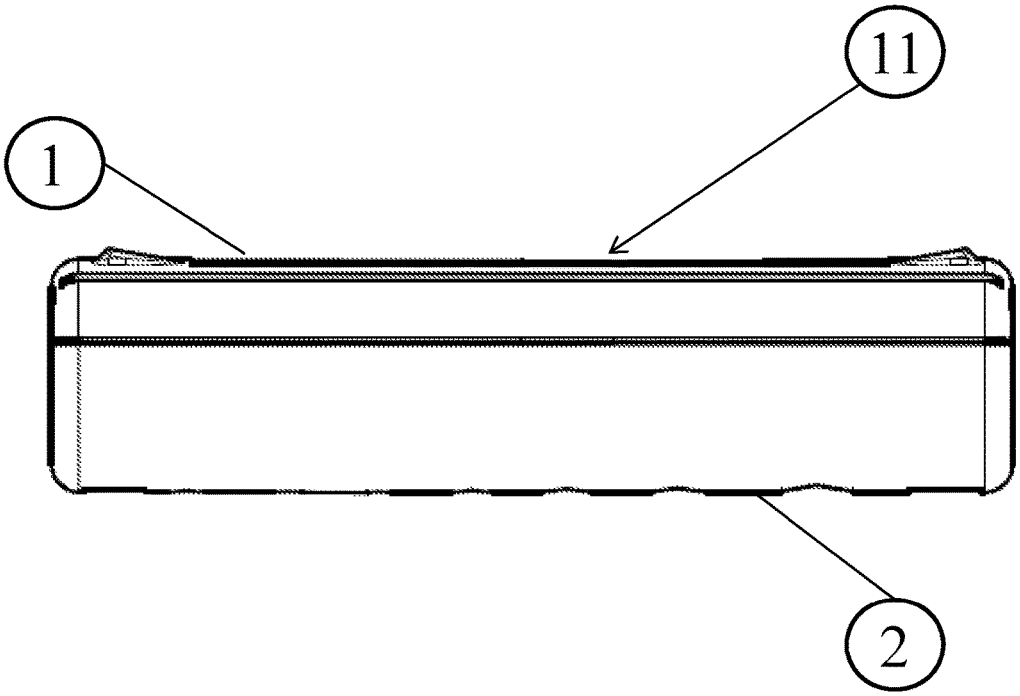
FIG. 5 is a side view of the device of the present invention.
Figure 6:
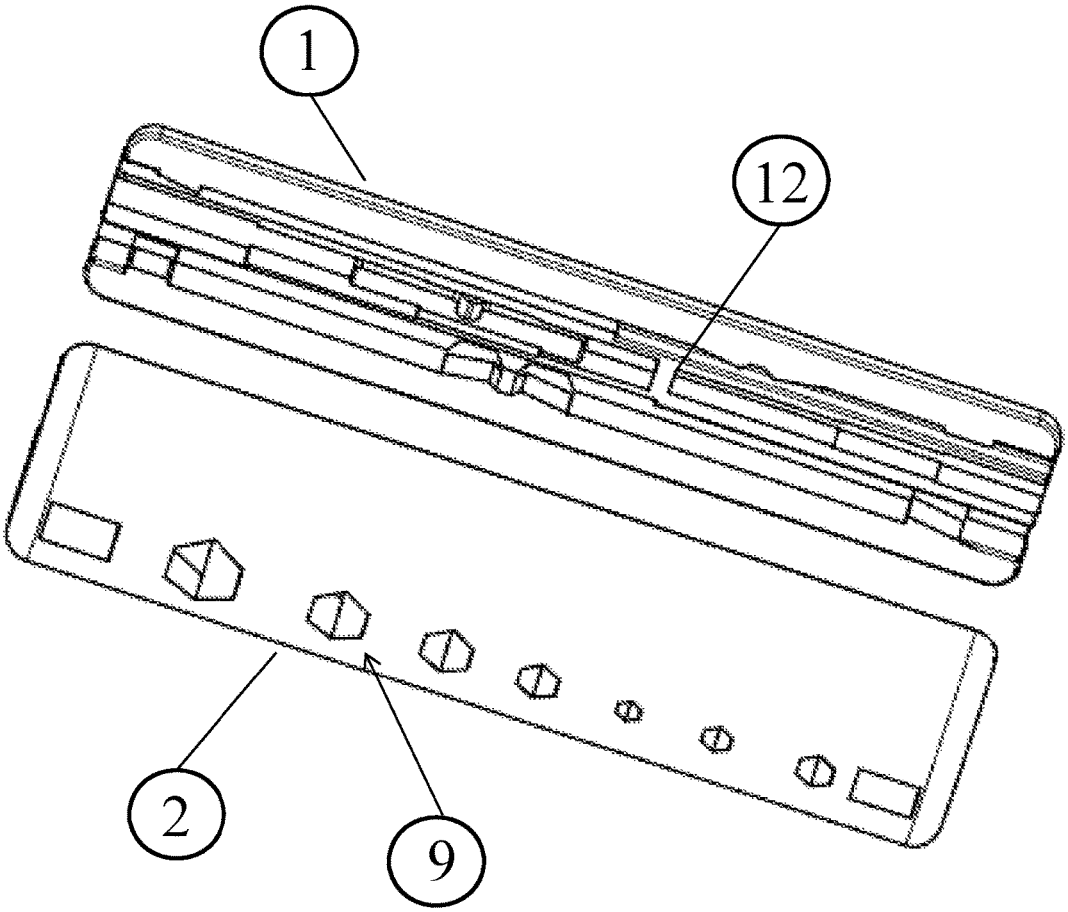
FIGS. 6-7 are expanded views of the device of the present invention illustrating the sliding wedge and body component parts of the invention and their relationship in combination to each other.
Figure 7:
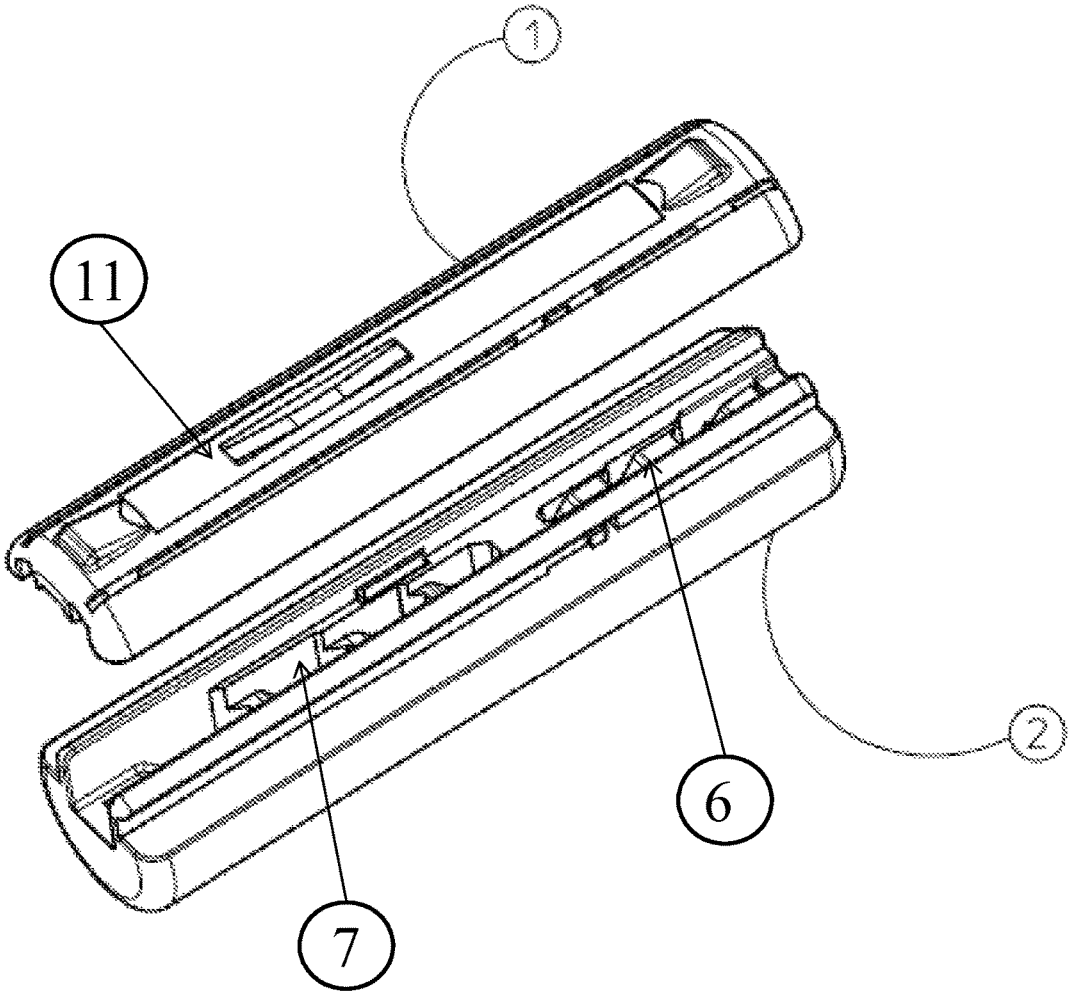

As shown in FIGS. 4 and 7, the various elevations of the lateral tool retainers 6 and 7 are positioned such that any of the plurality of tool sizes will be secured by a sliding wedge member 1 that moves not in a diagonally transverse direction like prior art devices, but on a single, lateral, X-axis direction that is parallel to the main X-axis of the handle—not at an angle relative to the main X-axis of the handle.

The distance that the sliding wedge 1 travels along the X-axis is defined by the position of each wrench along the channel and the location of the mating half-hex wedge features on the underside of the securing member. This linear, single axis movement is parallel and co-planar to the top of the plurality of tools. This is how the present invention is able to achieve a two piece construction of the wedge 1 and body 2 compared to the multi-transverse linkage motion constructions taught in the prior art.

The sliding wedge 1 of the present invention is free to travel laterally in both directions along the X-axis enough to expose the channel 13 from either the first end 18 or second end 19 and to expose and provide access to the groupings 6 and 7 and corresponding secondary tool channels 11, which allow the tools to be positioned in the channel 13 from either the first end 18 or second end 19 of the handle and protrude from the tool apertures 9.

The advantage of the present invention here is that the tools are able to be oriented such that with the smaller the tools, the closer it can be positioned toward the center of the handle, the more stable the tool is secured. The way it's achieved is that it allows more length of the long arm of the tool 20 to be held in the handle which provides a more secure clamping of the tool, and also reduces the amount of length that protrudes from the end of the handle. This is important because as the tools get smaller, the stability of the wrench is dependent on a combination of the clamping force and the clamping length. And with normal manufacturing tolerances, the smaller the tool, the looser the fit will be since the handle must be manufactured to accommodate the tolerances of the largest tool, which can be multiples of the size of the smallest tool. The new invention improves on the fit of the tools in the way of less play due to this additional securing length feature.

Yet another advantage that the laterally sliding X-axis wedge 1 and the greater travel distance it provides is that the sliding wedge 1 completely encloses the channel 13 when in the closed, operating position. This provides a continuously closed cylindrical profile around the entire circumference of the handle only interrupted by the plurality of tool apertures 9, which do not negatively affect the gripping function of the handle.

The prior art uses a transverse movement of a sliding wedge to secure the various sized tools 10 in the tool/handle. The step profiles of the seats for the wrenches in the prior art are arranged in a descending order so that the reference datum 28 is maintained while the wedge moves in a diagonal direction from the largest to the smallest wrench.

The prior art does not teach or suggest wrench exits located on both opposing ends of the tool/handle, only an opening on one end.

The underside of the sliding wedge 1 includes stepped walls 12 that match the size of each tool in order to constrain the lateral movement of the tool.

Figure 8:
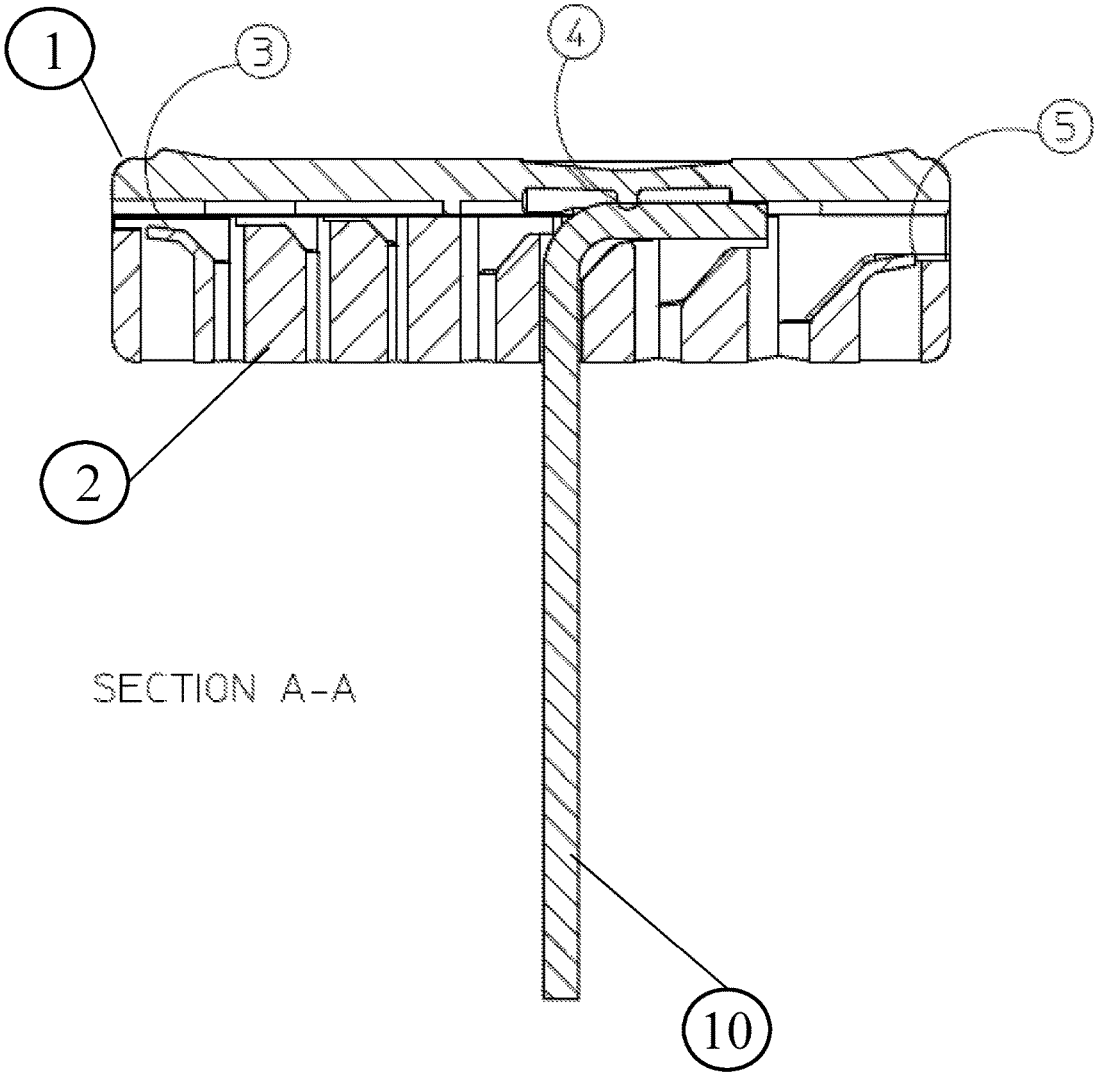
FIG. 8 is a section view of the present invention illustrating the relationship of the sliding wedge and body components with respect to a tab tensioner for small tools, a tab tensioner A for large tools as shown with tool in T-handle mode, and tab tensioner B for large tools in a hexagonal wrench in a T-handle position.

FIG. 8 illustrates the wrench in a T-handle mode where the long leg 20 of the wrench 10 is extended from the bottom of the tool/handle while the short leg 21 of the wrench is constrained inside the handle. Tab tensioners 3 for small tools and tab tensioners 4 for large tools apply a static pressure to the wrench 10 to keep it securely retained with in the sliding wedge 1 and body 2.

Figure 9:
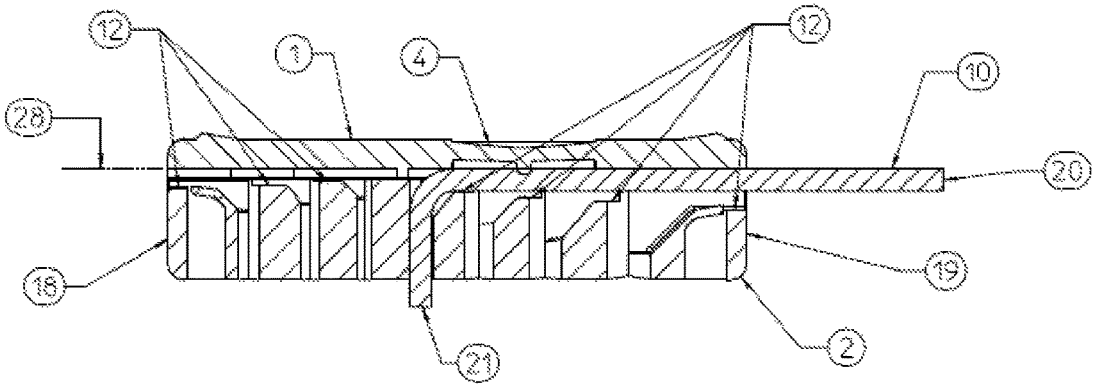
FIG. 9 is a section view of the present invention illustrating the relationship of the sliding wedge and body components with respect to a tool being retained in a screw driver position.

The Wrench is shown in a screwdriver mode in FIG. 9 allowing the tool to be used like a screw driver where the long leg 20 of a hexagonal wrench 10 is extended from one end of the tool/handle while the short leg 21 of the hexagonal wrench extends a much shorter amount from the bottom of the tool/handle if at all.

In orientation, T-handle mode or screwdriver mode, the tools are oriented in a stepped manner where the topmost surface is referenced to a datum. This datum 28 is a straight line that defines the underside of the sliding wedge 1 for all wrench sizes. This is what allows the assembly to require only two parts rather than the seven part embodiments taught in the prior art.

Figure 10:
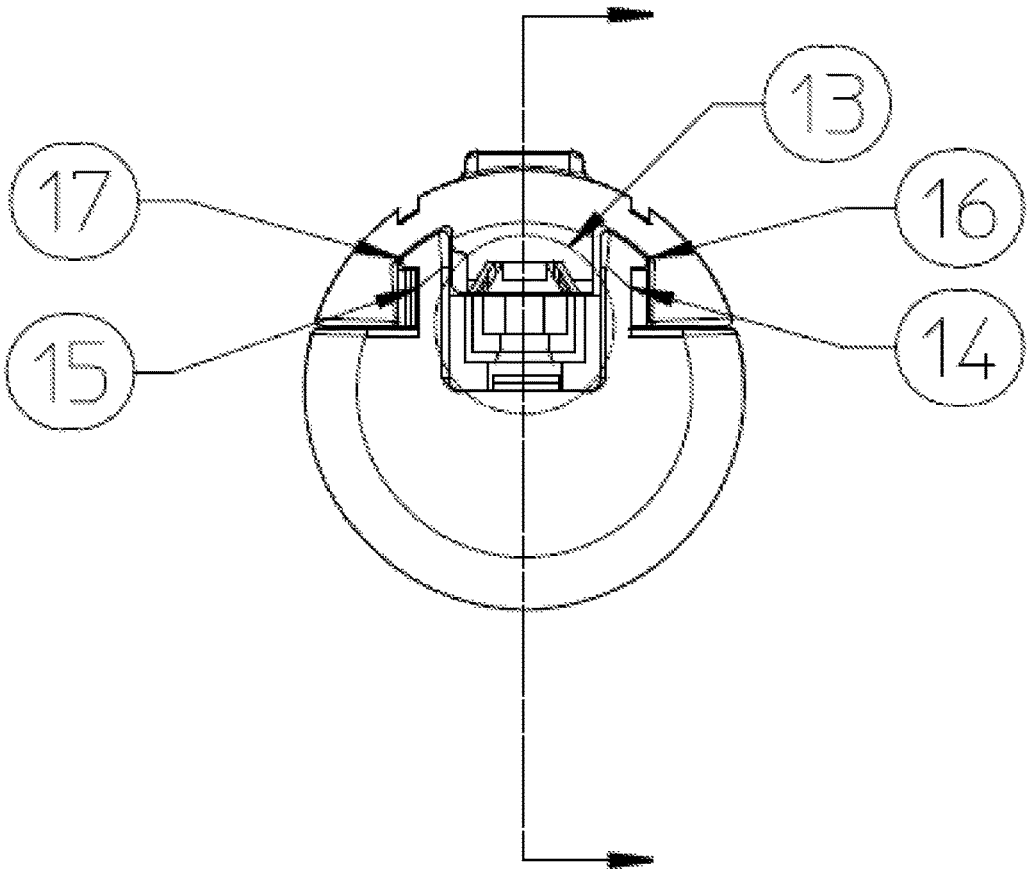
FIG. 10 is a section view illustrating the relationship of the sliding wedge and body components with respect to each other.
Figure 11A:
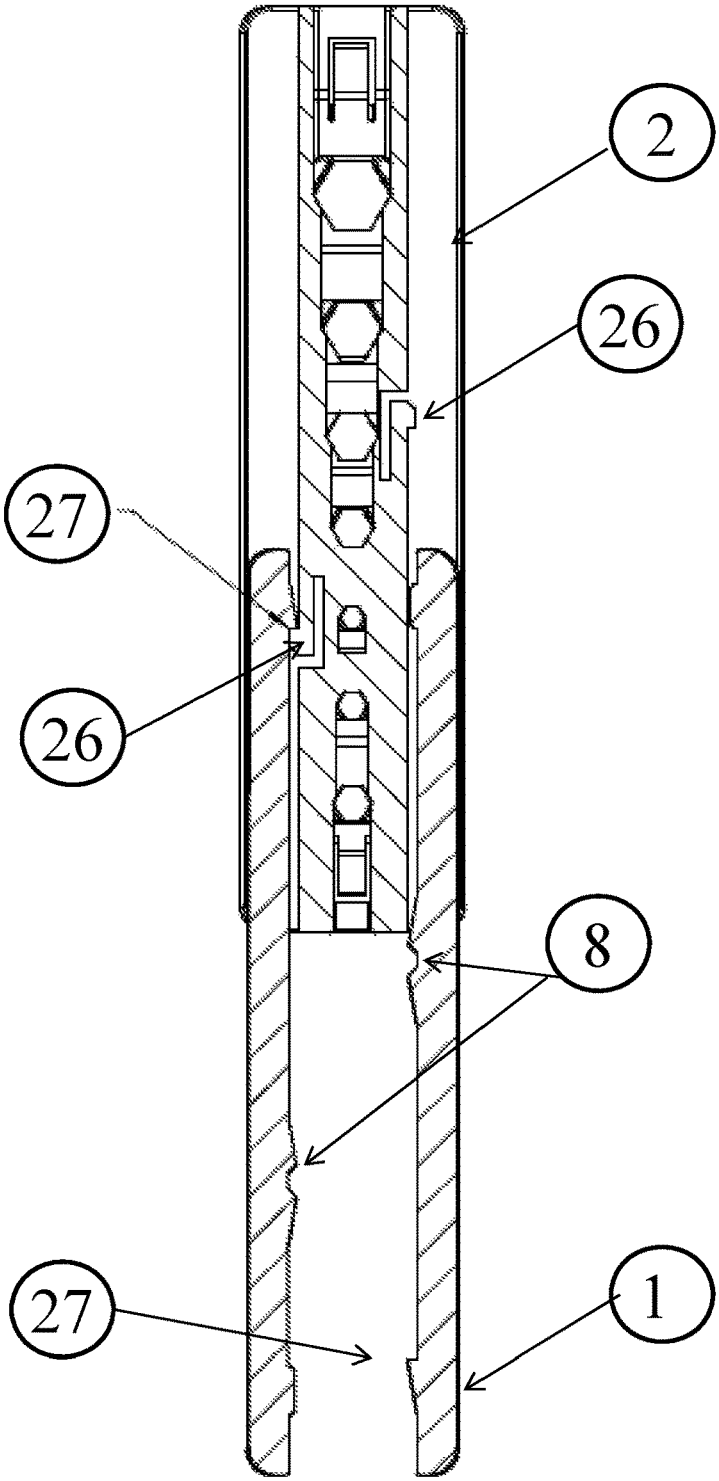
FIG. 11*a* is a cut away view illustrating the relationship of the sliding wedge and body components with respect to the hard stop detent features of the hook and catch as well as the closed position detent that engages the hook.
Figure 11B:
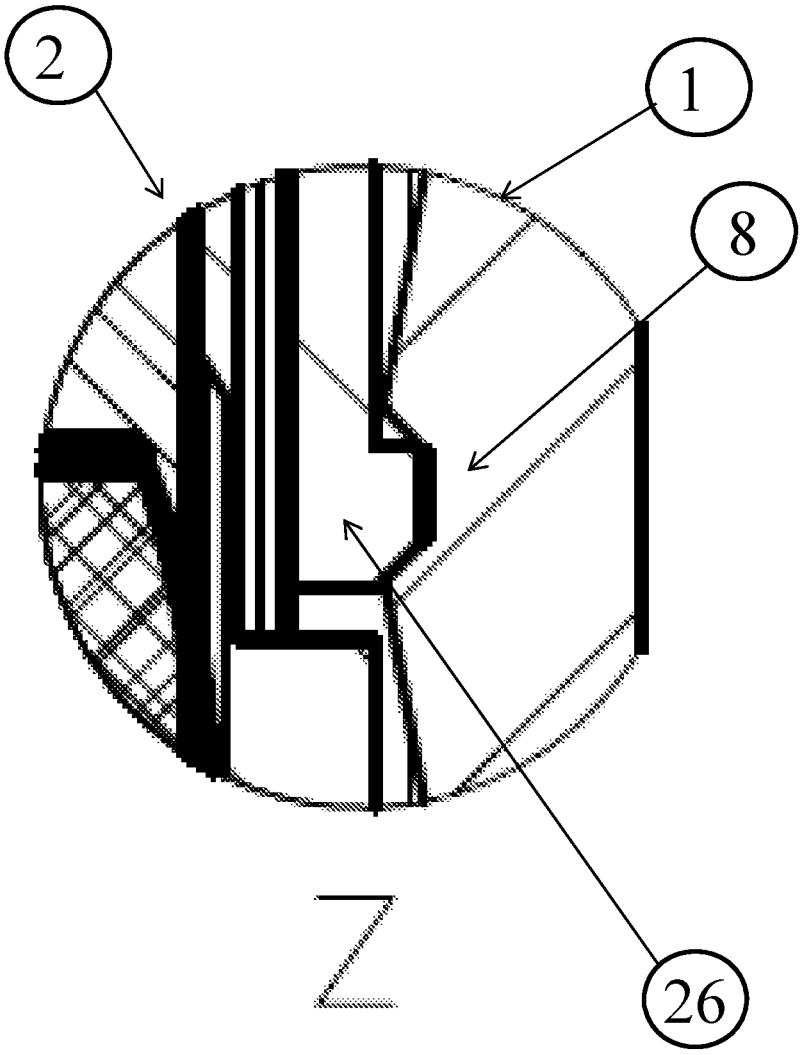
FIG. 11*b* is a close up of the hard stop detent feature identified as detail Z.
Figure 12:
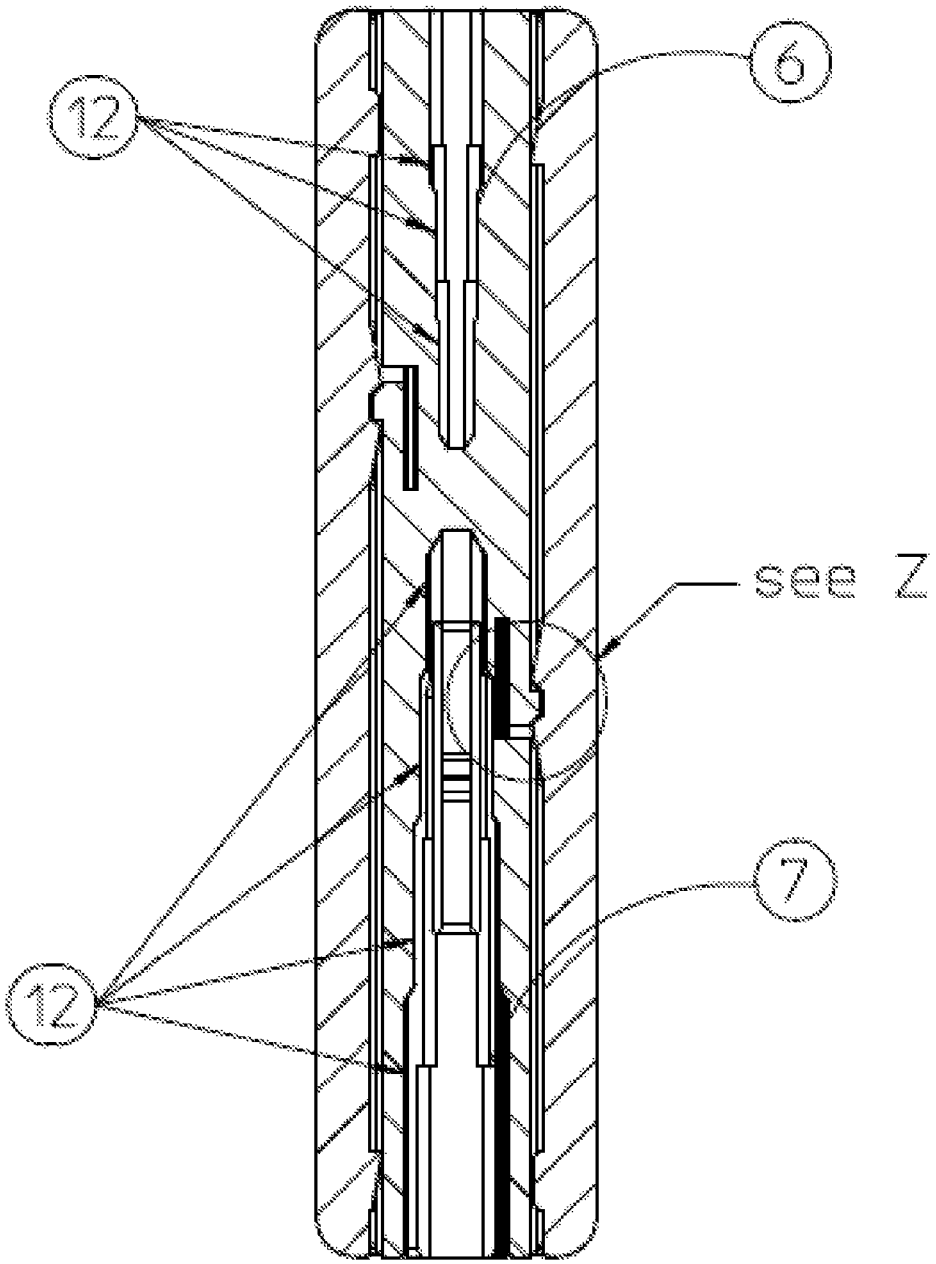
FIG. 12 is a section view illustrating the relationship of the sliding wedge and body components with respect to the hard stop detent feature and lateral retainer for large tools.

Now referring to FIGS. 10-12, the hard stop detent feature is illustrated. The sliding wedge 1 has a detent 8 on each side as well as a pair of catches 27 on each end of the sliding wedge 1 for engaging a pair of hooks 26 on the body portion when the slideable wedge 1 is moved in a horizontal, lateral manner with respect to the body as previously discussed. When the wedge and body are in a closed position, the detent 8 and hooks 26 are engaged and keep the wedge 1 and body 2 in a closed position unless an external force is used to separate them in either linear direction. When the wedge 1 is disengaged from the hooks 26 of the body and slide in one of the lateral directions, the motion continues until the hooks 26 engage on one of the pairs of catches 27 on the sliding wedge 1. When the hooks 26 engage the catches 27, the sliding motion of the wedge is stopped and it can not be slid any further in that direction, which means the two pieces, can not be intentionally or accidentally slid apart into two pieces and must remain engaged.

As shown in FIGS. 10-12, the sliding wedge 1 can be moved laterally in either direction with respect to the body 2, exposing either the lateral retain group for the small tools 6 or the lateral retainer group for the large tools 7.

Figures 13A, 13B, 13C, 13D:
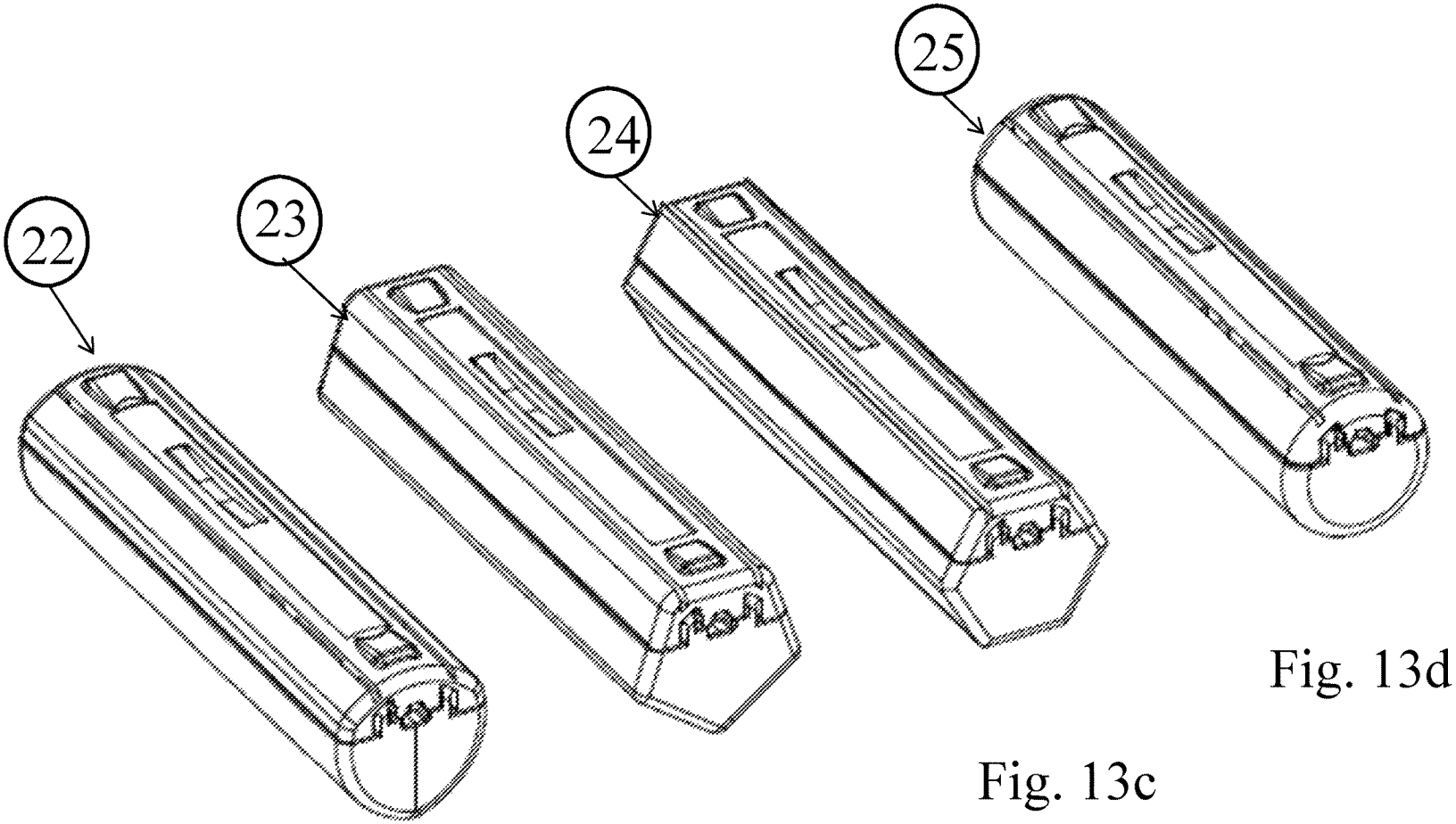
FIGS. 13*a*-13*d* illustrate four of the most common handle shape embodiments of the present invention.

In other prior art, less parts may be taught in an effort to provide a related solution, but those prior art teachings also require, include, and teach multiple slots on each of the multiple, often six, sides of the tool/part/handle, and the wedge is a hex or circular design that goes around the entire circumference of the handle. As shown in FIG. 13, the handle of the present invention, constructed from two parts, the sliding wedge 1, and body 2, can be molded so that the exterior shape of the handle, when in a closed position, is substantially circular almost a teardrop or rounded triangular shape 22, pentagonal 23, hexagonal 24, or circular 25. Thus, it is appreciated that the optimum dimensional relationships for the parts of the invention, to include variation in size, materials, shape, form, function, and manner of operation, assembly and use, are deemed readily apparent and obvious to one of ordinary skill in the art, and all equivalent relationships to those illustrated in the drawings and described in the above description are intended to be encompassed by the present invention.

Furthermore, other areas of art may benefit from this method and adjustments to the design are anticipated. Thus, the scope of the invention should be determined by the appended claims and their legal equivalents, rather than by the examples given.

The embodiments of the invention in which an exclusive property or privilege is claimed are defined as follows:

1. A tool handle for holding multiple tools of different sizes during use consisting of:

the handle further comprised of a wedge comprising a top portion and partial sides;

the wedge is further comprised of, two one-way stop limit catches which protrude toward a center longitudinal axis of the handle located on opposing ends, and two-way detents which protrude toward the center longitudinal axis of the handle located on opposing sides; and a body comprising a bottom portion and partial sides; wherein in combination the wedge and body create a handle having two ends, each end having an opening for engaging a tool;

the wedge retained in and laterally slideable along a channel in the body;

the body further comprising;

a pair of hooks each having a flat surface oriented perpendicular to the center longitudinal axis, which protrude away from the center longitudinal axis and includes a means for biasing the hooks in their outward direction, that slideably engage the two catches of the wedge; and the wedge slides laterally in either direction with respect to the body until the catches and hooks engage;

a plurality of openings for engaging a tool on the side of the body; and slots and step profiles corresponding to the openings that allow each size tool to be indexed to the underside of a sliding member of the wedge.

2. The tool handle of claim 1, wherein when in a closed position the two hooks of the body engage the two detents of the wedge and secure the wedge and body into a single position.

3. The tool handle of claim 1, wherein the arrangement and position of the hooks and catches allow the wedge to be extended beyond the body in a lateral manner to expose the slots and step profiles corresponding, but no longer than the end so the wedge and body remain engaged as one.

4. The tool handle of claim 3, wherein the hooks, catches, and detents integral to the wedge and body allow the wedge to be permanently snap-fit assembled onto the body to form a single unit.

5. The tool handle of claim 1, wherein a body channel positions tools on common plane with respect to a contact surface with the body.

6. The device of claim 5, wherein the body channel contains seven openings for engaging a tool.

7. The device of claim 1, wherein the tools can be a tool or wrench;

the tool can be hexagonal, round, or square in shape, or any plurality of shape combinations.

8. The tool handle device of claim 1, wherein the stepped slots in the body create a variable depth requirement corresponding to the depth requirements of tools of various size allowing the tools or hexagonal wrenches to sit at different heights; and the body has a tab tensioner associated with each of the internal tool slots for providing a static pressure against a tool.

9. The tool handle device of claim 1, further comprising two grouping arrangement of tools within the handle.

10. The tool handle device of claim 9, wherein the grouping arrangements face the opposite direction.

11. The device of claim 10, wherein the tools are oriented such that the smaller tools are positioned toward the center of the handle.

12. The tool handle device of claim 11, wherein the sliding member travels laterally in both directions along the center longitudinal axis with respect to the body enough to expose the channel from either a first or second, opposing end; and the corresponding groupings for providing access to the large tool and small tool openings allow the wrenches to be positioned in the channel from either the first or second end of the handle and protrude from a corresponding body tool aperture opening.

13. The tool handle device of claim 10, wherein a plurality of stepped slots are located internally in the body where the tool exits the body allowing a portion of the tool spread between the stepped slots; and part of the tool sits in the body channel; and part of the tool exits the end of the body.

14. The tool handle device of claim 1, wherein the slots are oriented at stepped elevations correlating to the size of a plurality of tool sizes.

15. The tool handle device of claim 1, wherein the sliding member moves in a single X-axis direction that is parallel to the center longitudinal axis of the handle.

16. The tool handle device of claim 1, wherein the distance that the sliding member travels along the linear X-axis is defined by the position of each wrench along the channel and the location of a mating, detent and catch features on the underside of the wedge.

17. The tool handle device of claim 16, wherein the sliding wedge traveling along this linear, single axis has a movement that is parallel and co-planar to the top of the plurality of tools.

18. The tool handle device of claim 1, wherein the wedge completely encloses the channel when in a closed, operating position; and provides a continuously closed cylindrical profile around the entire circumference of the handle only interrupted by the plurality of tool openings on the body.

19. The tool handle device of claim 1, wherein the step profiles of the seats for the tools in the body are arranged in a descending order so that a reference datum is maintained while the wedge moves in a lateral direction from a largest to a smallest tool or from the smallest to the largest tool.

20. The tool handle device of claim 1, wherein an underside of the wedge is further comprised of stepped walls that match the size of each tool in order to constrain the lateral movement of the tools; and a tab tensioner associated with each of the stepped walls for providing a static pressure against a tool.

21. The tool handle device of claim 1, further comprising tool exits located on both opposing ends of the handle.

22. The tool handle device of claim 21, wherein all tools protrude from either end of the handle in a screwdriver mode.

23. The tool handle device of claim 1, wherein in a T-handle mode a long leg of a tool is extended from the bottom of the tool/handle while a short leg of a tool is constrained inside the tool/handle.

24. The tool handle device of claim 1, wherein the wrenches are oriented in a stepped manner where a top most surface of the tool is referenced to a bottom plane of the wedge where the tool engages the body; and a datum is a straight line that defines an underside of the wedge for all wrench sizes.

25. The tool handle device of claim 1, wherein the wedge and body in combination are substantially a hex, tri-lobe, or circular in shape that extends around the entire circumference, forming the handle.

* * * * *